US010767305B2

(12) United States Patent
Wong et al.

(10) Patent No.: US 10,767,305 B2
(45) Date of Patent: Sep. 8, 2020

(54) STEAM IRON WITH THERMAL BRIDGE ARRANGEMENT

(71) Applicant: KONINKLIJKE PHILIPS N.V., Eindhoven (NL)

(72) Inventors: William Wai Lik Wong, Eindhoven (NL); Ruben Arnold Herman Reekers, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/079,163

(22) PCT Filed: May 2, 2017

(86) PCT No.: PCT/EP2017/060395
§ 371 (c)(1),
(2) Date: Aug. 23, 2018

(87) PCT Pub. No.: WO2017/191123
PCT Pub. Date: Nov. 9, 2017

(65) Prior Publication Data

US 2019/0048518 A1 Feb. 14, 2019

(30) Foreign Application Priority Data

May 2, 2016 (EP) ..... 16167968

(51) Int. Cl.
*D06F 75/24* (2006.01)
*D06F 75/12* (2006.01)
(Continued)

(52) U.S. Cl.
CPC ..... *D06F 75/24* (2013.01); *D06F 75/12* (2013.01); *D06F 75/14* (2013.01); *D06F 75/18* (2013.01);
(Continued)

(58) Field of Classification Search
CPC ..... D06F 5/00–5/38; D06F 71/36; F22B 1/28; F22B 1/284; F22B 1/285; F22B 35/00
See application file for complete search history.

(56) References Cited

U.S. PATENT DOCUMENTS 2,781,593 A * 2/1957 Schreyer ..... D06F 75/16 38/77.4
2,880,530 A * 4/1959 Schwaneke ..... D06F 75/18 38/144
(Continued)

FOREIGN PATENT DOCUMENTS

DE 4212286 A1 10/1993
EP 0137255 A2 4/1985
(Continued)

*Primary Examiner* — Ismael Izaguirre

(57) ABSTRACT

The present application relates to a steam iron (10) for ironing garments. The steam iron (10) comprises a steam generator (11), an ironing plate (13) and a thermal bridge arrangement (14). The steam generator (11) comprises a main body (11A) and a heating element (12) to heat the main body (11 A). The thermal bridge arrangement (14) extends between the main body (11A) and a thermal coupling area (15) of the ironing plate (13) to heat the ironing plate (13) by conduction of heat from the main body (11A). The thermal bridge arrangement (14) comprises a first portion (16) extending in a first direction (A) away from the thermal coupling area (15) and a second portion (17) extending in a second direction (B) towards the thermal coupling area (15). This invention allows promoting steam generation operating in a high temperature for a better steam capability, while keeping a lower temperature of the ironing plate which prevents damaging garments during ironing.

21 Claims, 9 Drawing Sheets

(51) Int. Cl.

| | |
|---|---|
| ***D06F 75/14*** | (2006.01) |
| ***D06F 75/18*** | (2006.01) |
| ***F22B 35/00*** | (2006.01) |
| ***F22B 1/28*** | (2006.01) |
| *D06F 75/26* | (2006.01) |

(52) U.S. Cl.
CPC ..... *F22B 1/284* (2013.01); *F22B 35/00* (2013.01); *D06F 75/26* (2013.01)

(56) References Cited

U.S. PATENT DOCUMENTS

| | | | | | |
|---|---|---|---|---|---|
| 4,352,252 | A * | 10/1982 | Brenot | F22B 1/288 | 122/39 |
| 4,586,278 | A * | 5/1986 | Cavalli | D06F 75/18 | 38/77.81 |
| 4,837,952 | A * | 6/1989 | Hennuy | D06F 75/18 | 38/77.7 |
| 5,279,054 | A * | 1/1994 | Chasen | D06F 75/24 | 219/254 |
| 5,780,812 | A * | 7/1998 | Klinkenberg | D06F 75/26 | 219/251 |
| 5,883,358 | A * | 3/1999 | Brandolini | D06F 75/24 | 219/257 |
| 6,212,332 | B1 * | 4/2001 | Sham | D06F 75/12 | 38/77.6 |
| 8,713,824 | B2 | 5/2014 | Wang | | |
| 2014/0298693 | A1 | 10/2014 | Tack | | |
| 2015/0021088 | A1 | 1/2015 | Wang | | |
| 2015/0330014 | A1 | 11/2015 | Mohankuma | | |

FOREIGN PATENT DOCUMENTS

| | | |
|---|---|---|
| JP | 2011047721 | 3/2011 |
| WO | 2016030175 A1 | 3/2016 |

* cited by examiner

STEAM IRON WITH THERMAL BRIDGE ARRANGEMENT

This application is the U.S. National Phase application under 35 U.S.C. § 371 of International Application No. PCT/EP2017/060395, filed on May 2, 2017, which claims the benefit of International Application No. 16167968.3 filed on May 2, 2016. These applications are hereby incorporated by reference herein.

FIELD OF THE INVENTION

The present invention relates to a steam iron and to a steam iron system comprising such a steam iron.

The invention has some applications in the field of garment care.

BACKGROUND OF THE INVENTION

Steam irons are known that include a steam generator and an ironing plate coupled to the steam generator and which contacts the garments to be ironed. Steam generated in the steam generator is expelled onto the garments through holes in the ironing plate. Such irons contain a controller, for example, control electronics, to control the operation of the steam generator within an ironing temperature range for generating steam. The ironing plate is passively heated by conduction of heat from the steam generator at the areas of contact between the steam generator and the ironing plate. The control electronics maintain the operation of the steam generator and the thermally coupled ironing plate within an ironing temperature range.

Steam generators in such known steam irons include a heating element. In certain circumstances, the thermal energy in the steam generator can cause the ironing plate to heat up to a temperature exceeding the upper limit of the ironing temperature range, at which point garments in contact with the ironing plate may be damaged. Such overheating can also create hot spots in the ironing plate proximate the areas where the steam generator is coupled to the ironing plate.

SUMMARY OF THE INVENTION

It is an object of the invention to provide a steam iron which substantially alleviates or overcomes one or more of the problems mentioned above.

The invention is defined by the independent claims. The dependent claims define advantageous embodiments.

According to the present invention, there is provided a steam iron for ironing garments. The steam iron comprises a steam generator comprising a main body and a heating element to heat the main body. The steam iron also comprises an ironing plate. The steam iron also comprises a thermal bridge arrangement extending between the main body and a thermal coupling area of the ironing plate to heat the ironing plate by conduction of heat from the main body. The thermal bridge arrangement comprises a first portion extending in a first direction away from the thermal coupling area and a second portion extending in a second direction towards the thermal coupling area.

The thermal bridge arrangement increases the cumulated length of the thermal path between the main body and the thermal coupling area with the ironing plate because the heat must first flow in the first direction along the first portion of the thermal bridge arrangement and subsequently flow in the second direction along the second portion of the thermal bridge arrangement. The increased cumulated length of the path of heat transfer between the main body and the ironing plate restricts the rate of heat transfer from the steam generator to the ironing plate and thus reduces the temperature of the ironing plate for a given temperature of steam generator. This is advantageous because it allows for a relatively high temperature of steam generator, to promote steam generation efficiency, while keeping a lower temperature of ironing plate, to prevent damage to a garment in contact with the ironing plate. In addition, an increased temperature of the steam generator results in an increased capability to handle higher rate of steam generation when water is initially over supplied to the steam generator for steam boost.

In addition, the restricted rate of heat transfer of the thermal bridge arrangement prevents any large fluctuations in the temperature of the main body of the steam generator from causing large fluctuations in the ironing plate temperature, for example, due to water being poured onto the steam generator to generate steam. Therefore, the thermal bridge arrangement acts as a thermal "damper" to allow the ironing plate temperature to remain more constant.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
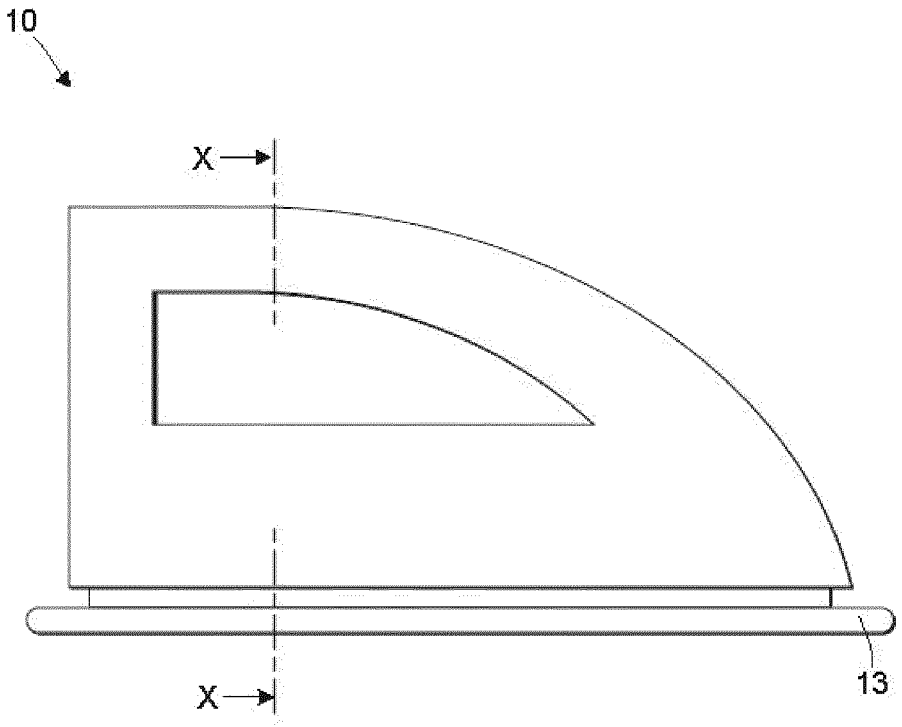
FIG. 1 is a schematic side view of a steam iron according to an embodiment of the invention.

FIG. 1 is a schematic side view of a steam iron 10 for ironing garments according to an embodiment of the invention. The steam iron 10 comprises an ironing plate 13. For sake of clarity, further details of the invention will be illustrated by FIGS. 2-5-6-7 showing a cross-sectional partial view of the steam iron 10 along the plan X-X.

Figure 2:
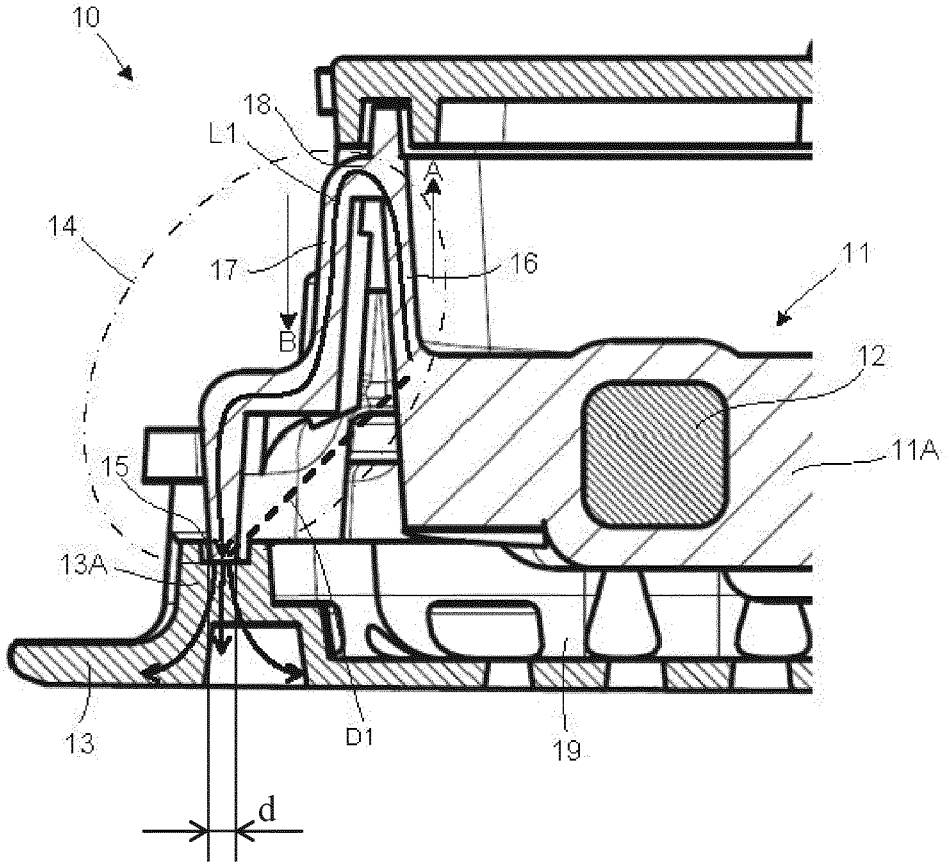
FIG. 2 is a schematic cross-sectional view of part of the steam iron of FIG. 1.

FIG. 2 is a schematic cross-sectional view of part of the steam iron of FIG. 1. The steam iron 10 comprises a steam generator 11 which comprises a main body 11A and a heating element 12 to heat the main body 11A. The steam iron 10 comprises a thermal bridge arrangement 14 extending between the main body 11A and a thermal coupling area 15 of the ironing plate 13 to heat the ironing plate 13 by conduction of heat from the main body 11A. The thermal bridge arrangement 14 comprises a first portion 16 extending in a first direction (shown by arrow A) away from the thermal coupling area 15 and a second portion 17 extending in a second direction (shown by arrow B) towards the thermal coupling area 15.

As it will be described in the following, it is noted that apart from comprising the first portion 16 and the second portion 17, the thermal bridge arrangement 14 may also comprise additional portions extending either away and/or towards the thermal coupling area A.

The heating element 12 is operable to heat the main body 11A of the steam generator 11 to generate steam. Moreover, heat is transferred from the heated main body 11A to the ironing plate 13 via the thermal bridge arrangement 14 such that the ironing plate 13 is passively heated (i.e. the ironing plate 13 does not embed a separate heating element). For example, the heating element 12 is a resistance intended to be connected to an electrical power supply. For example, the main body 11A of the steam generator 11 is a plate.

The thermal bridge arrangement 14 forms an indirect thermal path between the main body 11A and the ironing plate 13 to passively heat the ironing plate 13 by conduction of heat from the main body 11A.

The thermal bridge arrangement 14 increases the cumulated length (shown by the solid line L1 in FIG. 2) of the thermal path between the main body 11A and the thermal coupling area 15 with the ironing plate 13 since the heat flows in the first direction A along the first portion 16 of the thermal bridge arrangement 14, and flows in the second direction B along the second portion 17 of the thermal bridge arrangement 14. The increased cumulated length L1 of the path of heat transfer between the main body 11A and the ironing plate 13 restricts the rate of heat transfer to the ironing plate 13 and thus limits the temperature of the ironing plate 13 compared to the temperature of main body 11A. This is advantageous because having a relatively high temperature of steam generator 11 allows promoting the steam generation capability of the steam generator 11, and a having a lower temperature for the ironing plate 13 which prevents damaging garments in contact with the ironing plate 13 during ironing.

Reducing the thermal coupling area of the thermal bridge arrangement 14 increases the thermal resistance of the thermal bridge arrangement 14 and thus reduces the rate of heat transfer from the main body 11A to the ironing plate 13.

The steam iron 10 of the present invention allows reducing the rate of heat transfer from the main body 11A to the ironing plate 13 by increasing the cumulated length L1 of the thermal path between the main body 11A and the ironing plate 13.

The main body 11A and the thermal bridge arrangement 14 may be integrally formed and, for example, may be cast together. The main body 11A and the thermal bridge arrangement 14 may be manufactured from a metal, for example, aluminium or iron.

Preferably, as illustrated in FIG. 2, the first direction (A) of the first portion 16 extends away from the ironing plate (13).

The first direction A and/or second direction B may be perpendicular to the ironing surface of the ironing plate 13. Thus, the first portion 16 and/or second portion 17 of the thermal bridge arrangement 14 may extend substantially perpendicularly to the ironing surface of the ironing plate 13, as illustrated in FIG. 2.

In one embodiment, the thermal bridge arrangement 14 extends in the second direction B for a distance longer than in the first direction A, as illustrated in FIG. 2. For example, this can be achieved by having the second portion 17 being twice long as the first portion 16.

Preferably, the first portion 16 and the second portion 17 define a thermal path having a cumulated length L1 at least 1.5 time the distance D1 between the main body 11A and the thermal coupling area 15.

Preferably, the first portion 16 and the second portion 17 define a thermal path having an average cumulated length L1 that is at least 10 mm. By the term "average", it is meant that the mean value of the cumulated length is considered, which is measured over a middle point along the length of the thermal path, across the whole thermal coupling area.

Preferably, the heating element 12 is configured to heat the main body 11A to a temperature between 160° C. and 300° C. Under such conditions, the thermal bridge arrangement 14 preferably has a thermal transmittance and an average area (A) at the thermal coupling area 15 such that the ironing plate 13 has a temperature between 70° C. and 210° C. In case the thermal bridge arrangement 14 extends over a peripheral portion of the steam iron, the thermal coupling area 15 may also extends over this peripheral portion, and the average area (A) at the thermal coupling area 15 corresponds to the cumulated area over this peripheral portion.

The thermal transmittance and thermal coupling area of the thermal bridge arrangement 14 therefore allows for the main body 11A of the steam generator 11 to be heated to a relatively high temperature, for example 300° C., without the ironing plate 13 exceeding a temperature, for example 210° C., that would otherwise damage the garment in contact with the ironing plate 13. This is advantageous because the relatively high temperature of main body 11A means that the steam generator surface can contribute to a high amount of energy transfer to promote the efficiency of steam generation. In addition, the lower temperature of ironing plate 13 prevents damaging the garments in contact with the ironing plate 13. In addition, the relatively high temperature of the steam generator 11 results in an increased capability to handle higher rate of steam generation when water is initially over supplied to the steam generator 11.

Preferably, the thermal coupling area 15 has a thickness d between 1 to 3 mm. Preferably, the thermal coupling area 15 is a flat portion. The thermal bridge arrangement 14 may extend from the perimeter of the main body 11A of the steam generator 11. The thermal bridge arrangement 14 may extend from at least 75% of the perimeter of the main body 11A such that the thermal bridge arrangement 14 extends about at least 75% of the circumference of the main body 11A. In one such embodiment, the thermal bridge arrangement 14 is made of aluminium. In another embodiment, the thermal bridge arrangement 14 extends from all peripheral edges of the main body 11A.

The thermal transmittance of the thermal bridge arrangement 14 is dependent on the length L1 of the thermal bridge arrangement 14 and the thermal conductivity of the material (e.g. Aluminium) of the thermal bridge arrangement 14. Therefore, to achieve the necessary thermal management, these properties may be selected such that, if the main body 11A of the steam generator 11 is heated to between 160° C. and 300° C., the temperature of the ironing plate 13 has a temperature between 70° C. and 210° C.

For example, the necessary thermal transmittance and thermal coupling area A of the thermal bridge arrangement 14 may be selected after successive tests or simulations conducted by the skilled person, for instance, by varying the length L1 and the thermal coupling area A (result of contact wall thickness and contact perimeter), of the thermal bridge arrangement 14 until the heat transfer is achieved such that the energy flowing from the main body 11A, temperature of which is between 160° C. and 300° C., to the ironing plate 13 to maintain its temperature between 70° C. and 210° C. Those tests or simulations may be performed by successive experiments, for example, by heating the main body 11A to 300° C. and measuring the temperature of the ironing plate 13. Alternatively, the thermal transmittance and thermal coupling area may be calculated according to the following Equation 1:

$$Q=AU(T_1-T_2) \quad \text{[Equation 1]}$$

Wherein

Q (in W) is the heat transfer rate from the steam generator 11 to the ironing plate 13;

A (in $m^2$) is the cumulated thermal transfer area of the thermal bridge arrangement 14 (dependent on the perimeter and width of the thermal bridge arrangement 14);

U (in $W/m^2K$) is the thermal transmittance of the thermal bridge arrangement 14, which is the result of k (in W/mK), the thermal conductivity of the material used for making the steam generator, a material property, over L1, the length (in m) of the thermal bridge arrangement 14;

$T_1$ is the operation temperature (K/° C.) of the main body 11A;

$T_2$is the operation temperature (K/° C.) of the ironing plate 13.

Equation 1 shows that the temperature $T_2$ of the ironing plate 13 for a given temperature $T_1$ of the main body 11A is dependent on the thermal transmittance U of the thermal bridge arrangement 14 and the thermal coupling area A (in a direction perpendicular to the heat flow) of the thermal bridge arrangement 14.

For example, if aluminium material is selected for the steam generator and the thermal bridge arrangement (the value of k for aluminium is 205 W/mK), the energy supply required to maintain the ironing plate temperature, for a domestic steam iron, for example ~300 Watts; for a steam generator operating at 235° C., to achieve its ironing plate to be able to operate at 145° C., the length L1 of the thermal bridge arrangement 14 need to be ~36 mm with a thermal coupling area A of about 600 $mm^2$ that is achieved by arranging a ~1.2 mm thickness d contact at the coupling area along the circumference of the main body 11A By choosing parameters L1 and A, the desired heat transfer rate can be determined.

In another example, by choosing a different material for the steam generator and the thermal bridge arrangement, this material having a value of k as 96 W/mK, the length L1 of the thermal bridge arrangement can be chosen with a value around 17 mm for the same heat transfer condition as in the previous example, the other parameters being kept as same as in the previous example.

The first portion 16 may be connected to the second portion 17 by an intermediate portion 18 that allows changing the direction of those two portions.

The thermal bridge arrangement 14 according to the invention is generally U-shaped when viewed in cross-section. Alternatively, the thermal bridge arrangement can be generally V-shaped when viewed in cross-section.

The thermal coupling area 15 may comprise a protrusion 13A of the ironing plate 13 that extends towards an end of the second section 17 of the thermal bridge arrangement 14.

Preferably, the main body 11A and the ironing plate 13 face each other, and wherein an air gap 19 is provided between the main body 11A and the ironing plate 13. The air gap 19 thermally insulates the facing portions of the main body 11A and the ironing plate 13 and thus reduces the temperature of the ironing plate 13. The facing portions of the main body and ironing plate may comprise major surfaces of the main body and ironing plate. The ironing plate 13 is thus primarily heated by the main body 11A via the thermal bridge arrangement.

In one embodiment, the steam iron 10 further comprises a controller 20 (not shown) to control operations of the steam iron 10. In one such embodiment, the controller 20 is configured to perform a primary heating operation upon initial heating of the steam iron 10, and perform a secondary heating operation during subsequent operation of the steam iron 10. The primary heating operation comprises heating the steam generator 11 to a higher temperature range than for the secondary heating operation.

Optionally, the primary heating operation comprises heating the main body 11A to a much higher temperature, for example 240° C., than the ironing plate required temperature, for example 150° C. Optionally, the secondary heating operation comprises heating the main body 11A to a less higher temperature, for example 170° C., than the ironing plate required temperature.

The primary heating operation may be performed upon initial powering of the heating element 12. Heating of the main body 11A to the elevated temperature for the primary heating operation during start up ensures quicker heat transfer to the ironing plate 13 and so a quicker iron ready time. The thermal bridge arrangement 14 ensures that the ironing plate 13 does not overheat when the primary heating operation is performed. After the temperature of steam generator 11 drops close to, but higher than, the required operating temperature of ironing plate 13, while ironing plate temperature is rising from initial low level, the controller 20 performs the second heating operation so that the steam generator 11 is then operates at a lower operating temperature. For example, the required operating temperature of the ironing plate 13 may be about 150° C., initial temperature of which is 105° C., and the operating temperature of the steam generator 11 for the first heating operation may be around 240° C. and the second heating operation may be around 170° C.

The main body 11A and the thermal bridge arrangement 14 can be integrally formed and the thermal bridge arrangement 14 abuts the thermal coupling area 15 of the ironing plate 13. In an alternative embodiment, the thermal bridge arrangement 14 is integrally formed with the thermal coupling area 15 of the ironing plate 13 and abuts the main body 11A without being integrally formed with the main body 11A. In yet another embodiment, the thermal bridge arrangement 14 is integrally formed with both the main body 11A and the thermal coupling area 15 of the ironing plate 13.

In the above described embodiments, the thermal bridge arrangement 14 is configured such that the first portion 16 and second portion 17 each extend substantially parallel or perpendicular to the ironing surface of the ironing plate 13. However, it should be recognised that other configurations of thermal bridge arrangement 14 are also intended to fall within the scope of the invention and, for example, the first portion 16 and second portion 16 may each extend at an angle to the ironing surface which is neither parallel nor perpendicular.

Figure 3:
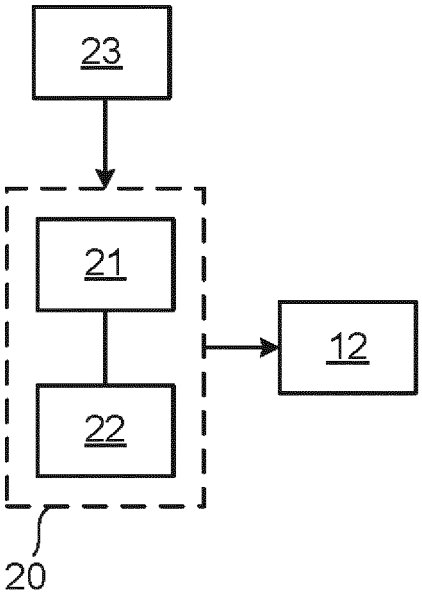
FIG. 3 is a block diagram schematically representing a controller of the steam iron of FIG. 1.

FIG. 3 is a block diagram schematically representing an exemplary configuration of the controller 20.

Optionally, the controller 20 comprises a processor 21 and a memory 22. The memory 22 may store a number of control parameters for controlling the operation of the steam iron 10, such as various threshold temperatures for the steam generator 11 and optimum operating temperatures for the ironing plate 13 and/or the steam generator 11.

Optionally, the steam iron 10 comprises a temperature sensor 23, for example, a thermocouple or thermistor, which measures the temperature of the steam generator 11. The controller 20 may be connected to the temperature sensor 23 so as to receive signals relating to the temperature of the steam generator 11. The controller 20 may be connected to the heating element 12 of the steam generator 11 in order to control operation of the heating element 12 in accordance with the control scheme described above.

Optionally, the steam iron 10 further comprises a temperature sensor (not shown), for example, a thermistor or thermocouple, configured to measure the temperature of the ironing plate 13, and the controller 20 is connected to said temperature sensor to receive signals relating to the temperature of the ironing plate 13.

Figure 4:
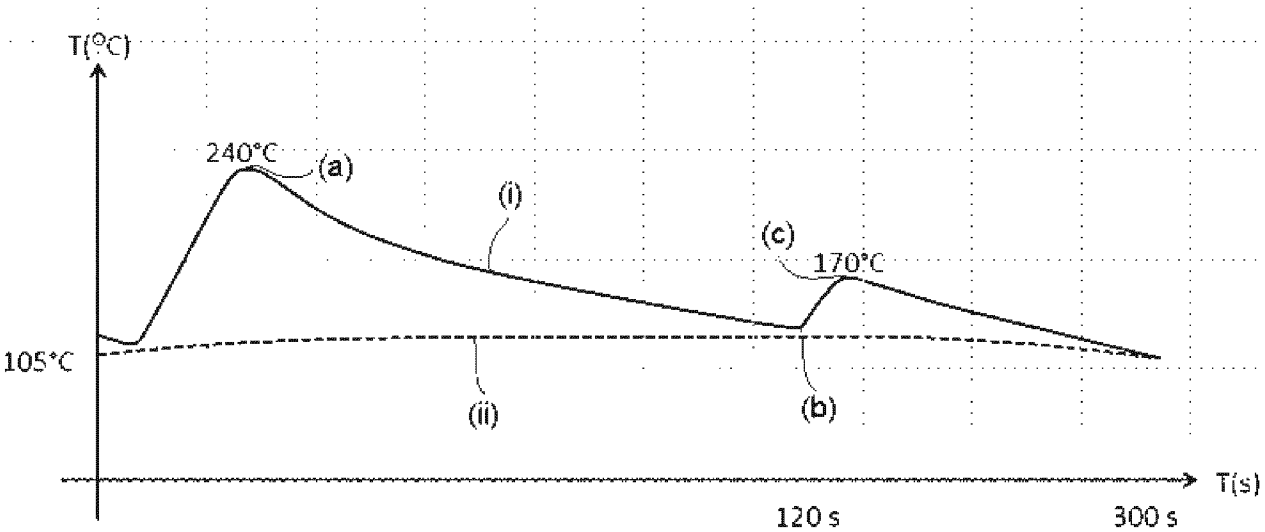
FIG. 4 is a graph of temperature against time schematically illustrating a control operation performed by the controller of FIG. 3.

FIG. 4 is a graph of temperature against time showing a schematic representation of an exemplary control operation of the controller 20.

Line (i) represents the temperature of the steam generator 11.

Line (ii) represents the temperature of the ironing plate 13.

Peak (a) of line (i) represents the steam generator 11 being heated during the primary heating operation, for example to 240° C.

Trough (b) of line (i) represents the steam generator 11 cooling, to a temperature of for example 155° C.

Peak (c) of line (i) represents the steam generator 11 being heated during the secondary heating operation to 170° C.

Figure 5:
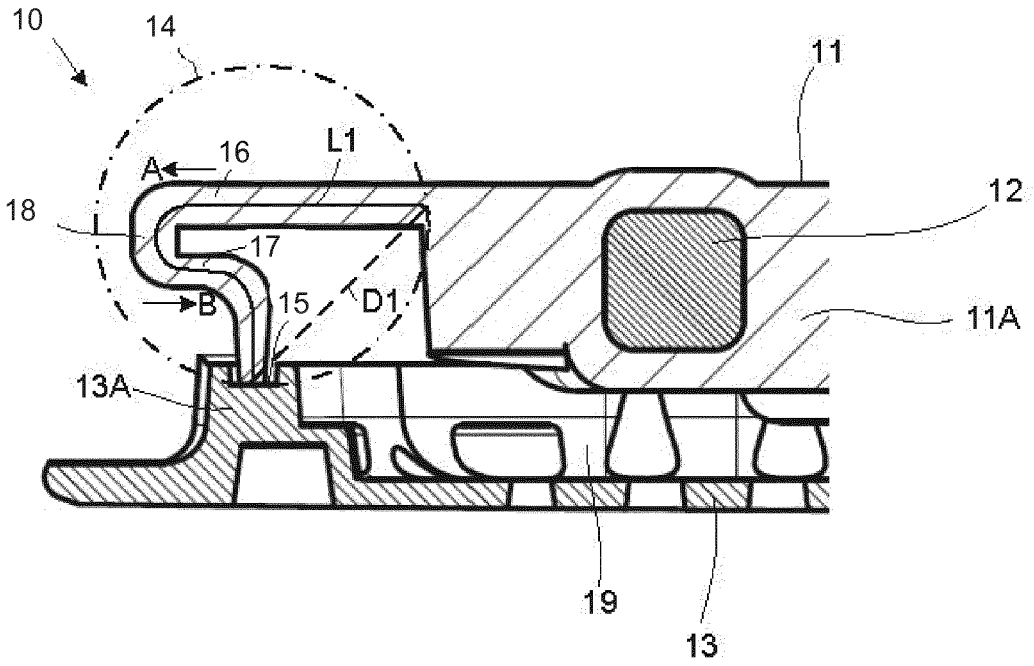
FIG. 5 is a schematic cross-sectional view of a steam iron according to another embodiment of the invention; and, FIG. 6 is a schematic cross-sectional view of a steam iron according to another embodiment of the invention.

Referring now to FIG. 5, a steam iron 10 according to another embodiment of the invention is shown.

The steam iron 10 of FIG. 5 is similar to the steam iron 10 described above in relation to FIGS. 2. A difference is that the thermal bridge arrangement 14 of FIG. 5 has a different structure.

The thermal bridge arrangement 14 comprises a first portion 16 extending in a first direction (shown by arrow 'A') away from the thermal coupling area 15, and a second portion 17 extending in a second direction (shown by arrow 'B') towards the thermal coupling area 15.

The first portion 16 extends from the main body 11A in the first direction A substantially parallel to the ironing surface of the ironing plate 13. The second portion 17 extends in the second direction B substantially parallel to the ironing surface of the ironing plate 13, but in the opposite direction to the first direction A. For example, as illustrated, the thermal bridge arrangement 14 extends in the first direction A for a distance longer than in the second direction B, as illustrated in FIG. 5.

Figure 6:
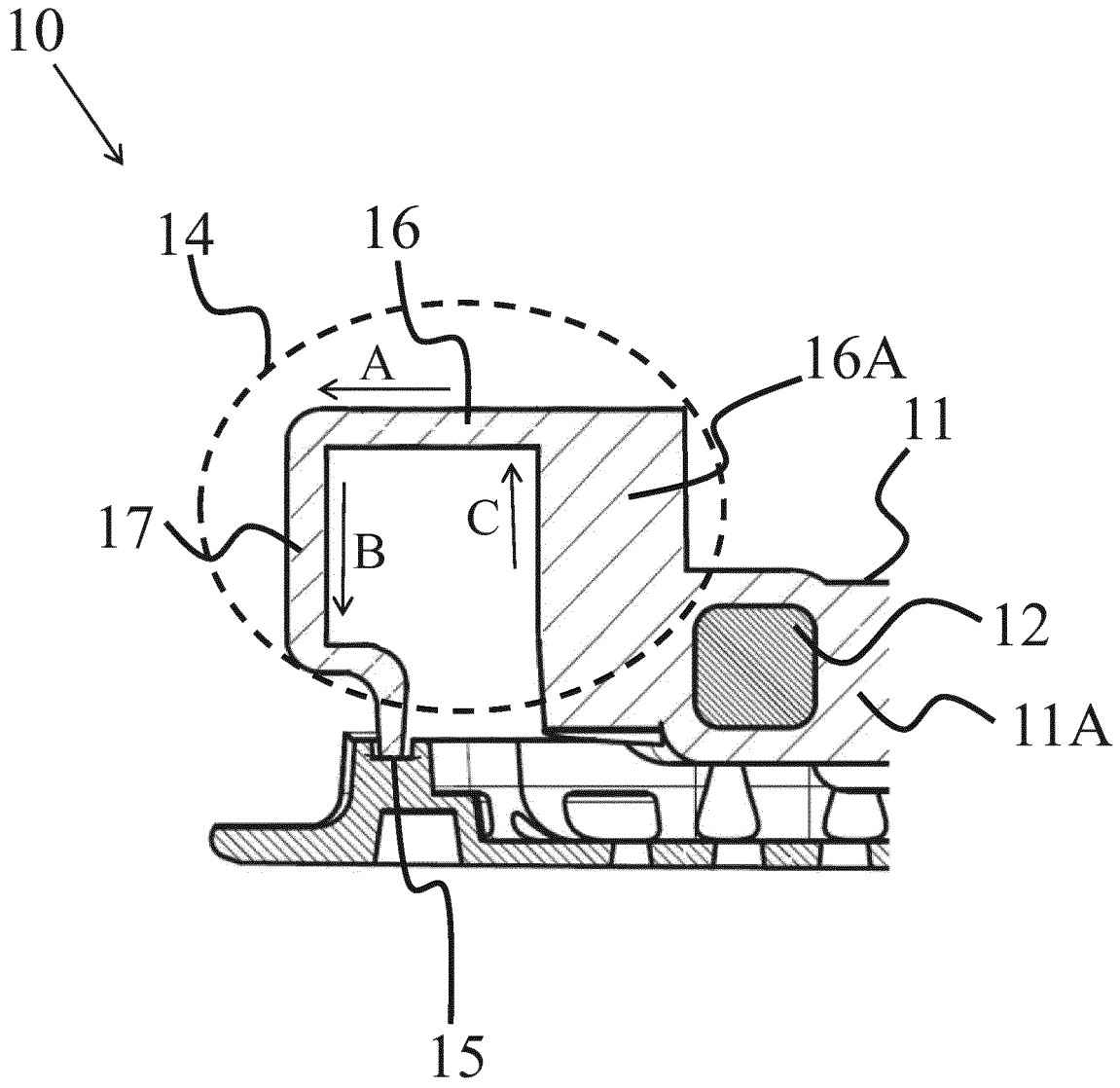

Referring now to FIG. 6, a steam iron 10 according to another embodiment of the invention is shown.

The steam iron 10 is similar to the steam iron 10 described above in relation to FIGS. 5. A difference is that the thermal bridge arrangement 14 of FIG. 6 has a different structure.

The thermal bridge arrangement 14 comprises a first portion 16 extending in a first direction (shown by arrow 'A') away from the thermal coupling area 15, and a second portion 17 extending in a second direction (shown by arrow 'B') towards the thermal coupling area 15. Additionally, the thermal bridge arrangement 14 comprises a third portion 16A extending in a third direction (shown by arrow 'C') away from thermal coupling area 15. The third portion 16A extends upwards from the main body 11A, and has, for example, a thickness relatively larger (e.g. 2 to 5 times) than the thickness of the first and second portions.

Figure 7:
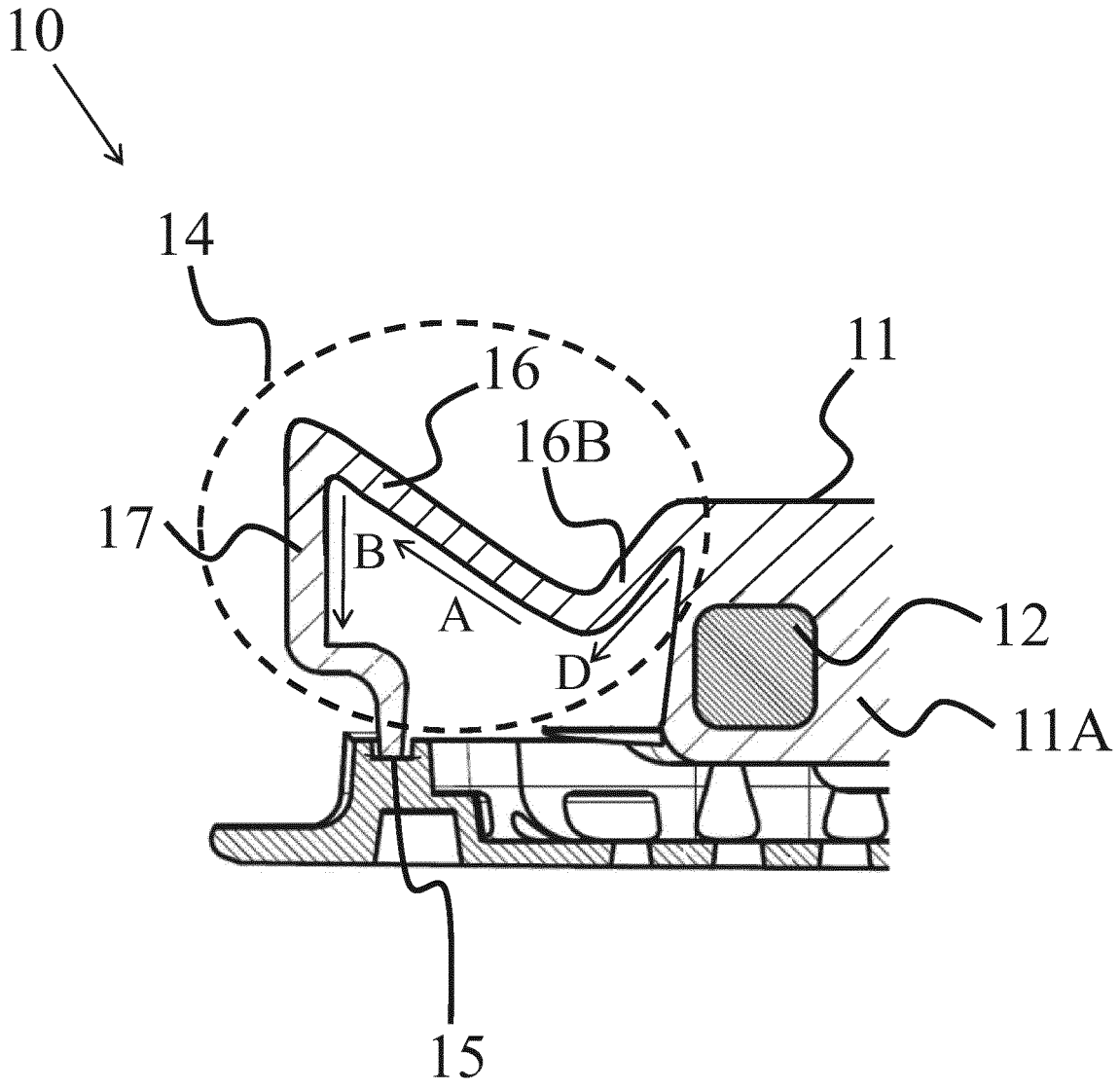
FIG. 7 is a schematic cross-sectional view of a steam iron according to another embodiment of the invention.

Referring now to FIG. 7, a steam iron 10 according to another embodiment of the invention is shown.

The steam iron 10 is similar to the steam iron 10 previously described. A difference is that the thermal bridge arrangement 14 of FIG. 7 has a different structure.

The thermal bridge arrangement 14 comprises a first portion 16 extending in a first direction (shown by arrow 'A') away from the thermal coupling area 15, and a second portion 17 extending in a second direction (shown by arrow 'B') towards the thermal coupling area 15. Additionally, the thermal bridge arrangement 14 comprises a third portion 16B extending in a fourth direction (shown by arrow 'D') towards from the thermal coupling area 15. The third portion 16B extends downwards from the main body 11A.

Optionally, the mass of the steam generator 11 is greater than about 300 g and, preferably, greater than about 450 g. Preferably, the mass of the steam generator 11 is at least 500 g. In some embodiments, the steam generator 11 is manufactured from aluminium and may be cast.

Optionally, the mass of the ironing plate 13 is less than about 250 g. Preferably, the mass of the ironing plate 13 is less than 150 g. In some embodiments, the ironing plate 13 is manufactured from aluminium and may be cast.

Preferably, the steam generator 11 and the ironing plate 13 each have a heat capacity, and the ratio of the heat capacity of the steam generator 11 to the heat capacity of the ironing plate 13 is between 3:1 and 4:1.

The larger heat capacity of the steam generator means that the steam generator is able to store more thermal energy and therefore more thermal energy is available to evaporate water into steam than if the water was only heated directly by the heating element or if the heat capacity of the steam generator was smaller. Thus, the larger heat capacity of the steam generator allows for an increased steam generation rate because an increased rate of water can be supplied to the steam generator and evaporated into steam. In addition, the larger heat capacity of the steam generator means that the steam generator remains above the temperature required to generate steam for a relatively long period of time because more thermal energy is stored in the steam generator. Thus, the steam iron can be used without powering the heating element for a relatively long period of time, which is particularly advantageous if the steam iron is cordless. The smaller heat capacity of the ironing plate means that the ironing plate is heated to within the desired temperature range relatively quickly and, furthermore, means that if the temperature of the ironing plate reduces, for example, due to contact with a cooler garment, the ironing plate may be reheated to within the desired temperature range relatively quickly by heat transfer from the steam generator via the thermal bridge arrangement.

The relatively high heat capacity of the steam generator 11 means that the steam generator 11 is able to stay above the temperature required to effectively generate steam, for example, 100° C. or 105° C., for a relatively long period of time. Thus, the steam iron 10 may be used without powering the heating element 12 for a relatively long period of time. For example, if the steam iron 10 is a cordless steam iron 10 (i.e. without embedded electrical supply to power the heating element), then it may be used for a longer period of time without being reconnected to a power source. The relatively small heat capacity of the ironing plate 13 means that the ironing plate 13 is heated to within the desired temperature range relatively quickly and, furthermore, means that if the temperature of the ironing plate 13 reduces, for example, due to contact with a cooler garment, the ironing plate 13 may be reheated to within the desired temperature range relatively quickly by heat transfer from the steam generator 11.

The stored thermal energy level in the steam generator 11 over the working temperature range of the steam generator 11 (i.e. whilst the steam generator 11 remains above the minimum temperature necessary to effectively generate steam, for example, 105° C.) may be characterised by following Equation 2:

$$E=mC_p(T_{initial}-T_{min}) \quad \text{[Equation 2]}$$

Wherein E is the stored thermal energy (J) in the steam generator 11, m is the mass (kg) of the steam generator 11, $C_p$ is the specific heat capacity (J/kgK) of the material of the steam generator 11, $T_{initial}$ is the temperature (° C.) of the steam generator 11 after heating, and $T_{min}$ is the minimum temperature (° C.) of the steam generator 11 required to effectively generate steam.

Thus, Equation 2 shows that increasing the heat capacity of the steam generator 11, for example, by increasing the mass m thereof, increases the stored thermal energy level E in the steam generator 11 over the working temperature range of the steam generator 11. In addition, the restricted rate of heat transfer provided by the thermal bridge arrangement 14 allows the steam generator 11 to be heated to a higher temperature $T_{initial}$ without the ironing plate 13 exceeding a temperature that would damage garments, which also increases the stored thermal energy level E in the steam generator 11.

Preferably, the heat capacity of the steam generator 11 is at least 450 J/K, where J is the energy in Joules and K the temperature in degrees Kelvin.

The heat capacity of the steam generator 11 may comprise the heat capacity of the main body 11A.

Preferably, the heat capacity of the ironing plate (13) is less than 150 J/K.

The steam iron 10 according to the invention may correspond to any of the following products:

- a corded steam iron (i.e. comprising a cord to be connected to external power supply to provide electrical energy to the heating element 12). Preferably, the corded steam iron comprises a water reservoir and optionally a water pump to carry water from the water reservoir to the steam generator 11. Alternatively, the corded steam iron is adapted to cooperate with a base station comprising a water reservoir and a water pump to carry water from the water reservoir to the steam generator 11 via the cord.
- a cordless steam iron (i.e. without any cord to provide electrical energy to the heating element 12). Preferably, the cordless steam iron is adapted to cooperate with a docking station as it will be further illustrated in FIG. 8A-8B.

Figure 8A:
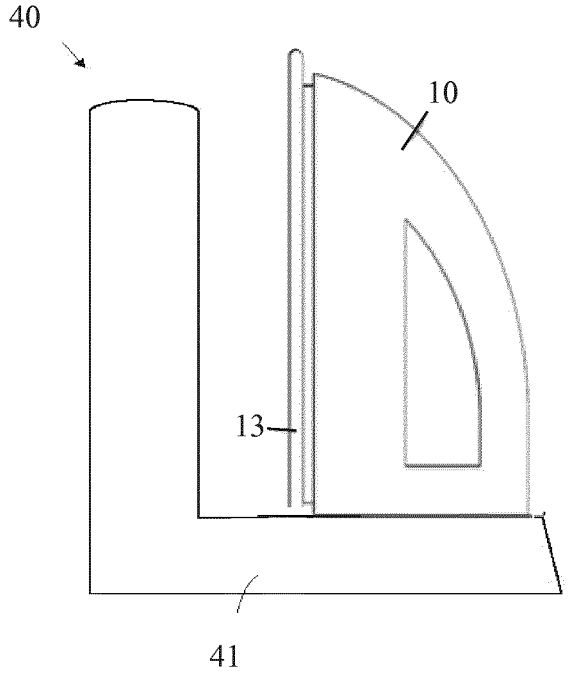
FIGS. 8A-8B are schematic side views of a first steam iron system according to an embodiment of the invention.
Figure 8B:
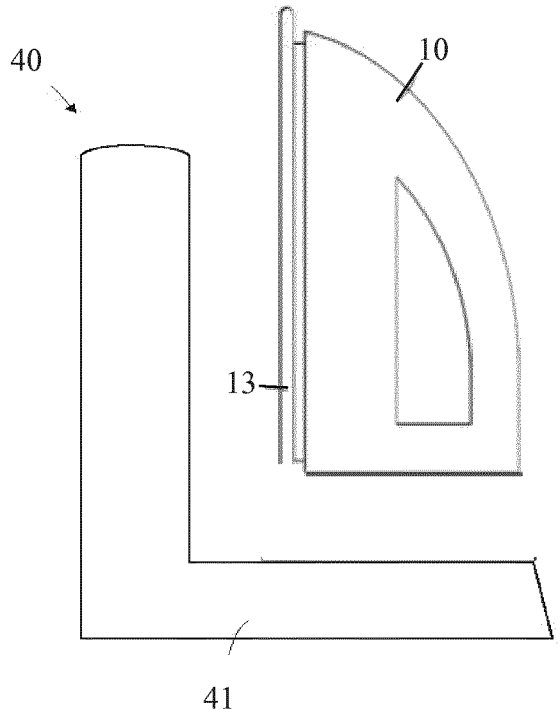

FIGS. 8A-8B show a first steam iron system 40 according to an embodiment of the invention.

The steam iron system 40 comprises a steam iron system 10 of the type described above in relation to FIGS. 2-5-6-7. The steam iron system 40 further comprises a docking station 41 for detachably resting the steam iron 10. In one embodiment, the user may rest the heel of the steam iron 10 on the docking station 41 when the steam iron 10 is not being used to iron a garment. The rest position is illustrated in FIG. 8A, and the detached position is illustrated in FIG. 8B.

Optionally, the heating element 12 (not shown) is powered when the steam iron 10 is rested on the docking station 41. In one embodiment, the docking station 41 and steam iron 10 each comprise a connector (not shown). The connectors may be configured to engage with each other when the steam iron 10 is resting on the docking station 41 to provide power to the heating element 12 and/or the controller 20. Thus, when the user rests the steam iron 10 on the docking station 41, power is provided to the heating element 12 such that the heating element 12 heats the main body 11A of the steam generator 11 and also passively heats the ironing plate 13 via the thermal bridge arrangement 14. Optionally, the connectors may comprise a male and female connector, for example, a plug and socket configuration.

In one embodiment, the controller 20 (not shown) is provided in the docking station 41.

In another embodiment, the controller 20 (not shown) is provided in the steam iron 10, but is only powered when the steam iron 10 is rested on the docking station 41. Alternatively, the controller 20 is powered by an energy storage device, for example a battery or a capacitor arranged in the steam iron 10, when the steam iron 10 is detached from docking station 41.

In one embodiment, there is no active temperature control of the heating element 12 when the steam iron 10 is detached from the docking station 41.

Figure 9:
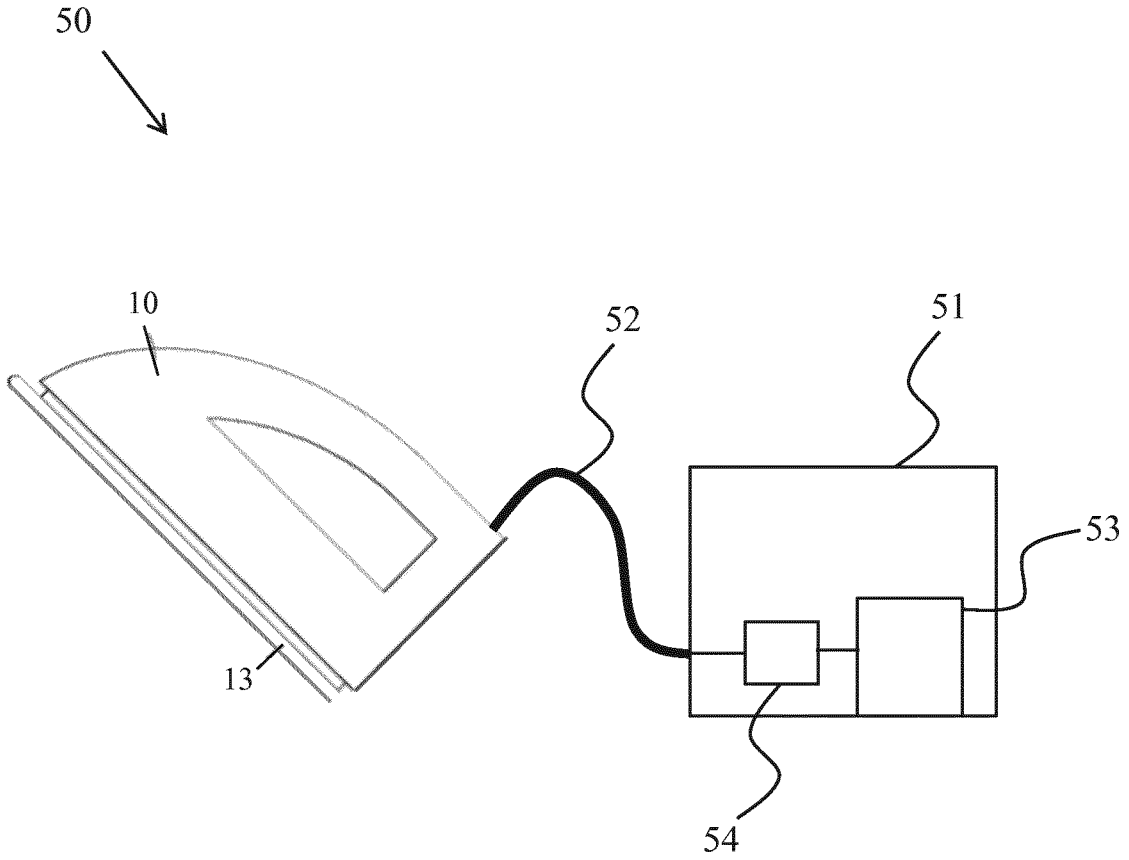
FIG. 9 is schematic view of a second steam iron system according to an embodiment of the invention.

FIG. 9 shows a second steam iron system 50 according to an embodiment of the invention.

The steam iron system 50 comprises a steam iron system 10 of the type described above in relation to FIGS. 2-5-6-7. The steam iron system 50 further comprises a base station 51 cooperating with the steam iron 10 via a cord 52.

The base station 51 comprises a water reservoir 53 and a water pump 54 to carry water from the water reservoir 53 to the steam generator 11 (not shown) via the cord 52. The heating element 12 (not shown) is power supplied from the base station 51 via the cord 52.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the spirit and scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A steam iron for ironing garments, the steam iron comprising:

a steam generator comprising a main body and a heating element to heat the main body;

an ironing plate; and, a thermal bridge arrangement extending between the main body and a thermal coupling area of the ironing plate to heat the ironing plate by conduction of heat from the main body, wherein the thermal bridge arrangement comprises a substantially vertical first portion extending in a first direction away from the thermal coupling area and a second substantially vertical portion extending in a second direction towards the thermal coupling area, and wherein at least one of the first portion and second portion may extend substantially perpendicular to the ironing surface of the ironing plate, wherein the thermal bridge arrangement forms an indirect thermal path between the main body and the ironing plate to passively heat the ironing plate by conduction of heat from the main body.

2. A steam iron according to claim 1, wherein the first portion and the second portion define a thermal path having a cumulated length (L1) at least 1.5 time the distance (D1) between the main body and the thermal coupling area.

3. A steam iron according to claim 1, wherein the first portion and the second portion define a thermal path having an average cumulated length (L1) that is at least 10 mm.

4. A steam iron according to claim 1, wherein the steam generator and the ironing plate each have a heat capacity, the ratio of the heat capacity of the steam generator to the heat capacity of the ironing plate being between 3:1 and 4:1.

5. A steam iron according to claim 4, wherein the heat capacity of the steam generator is at least 450 J/K.

6. A steam iron according to claim 4, wherein the heat capacity of the ironing plate is less than 150 J/K.

7. A steam iron according to claim 1, wherein the heating element is configured to heat the main body to between 160° C. and 300° C.

8. A steam iron according to claim 7, wherein the thermal bridge arrangement has a thermal transmittance and an average area (A) at the thermal coupling area such that the ironing plate has a temperature between 70° C. and 210° C.

9. A steam iron according to claim 1, wherein the thermal coupling area has a thickness (d) between 1 to 3 mm.

10. A steam iron according to claim 1, wherein the main body and the ironing plate face each other, and wherein an air gap is provided between the main body and the ironing plate.

11. A steam iron according to claim 1, further comprising a controller to control operations of the steam iron, wherein the controller is configured to perform a primary heating operation upon initial heating of the steam iron, and perform a secondary heating operation during subsequent operation of the steam iron, wherein the primary heating operation comprises heating the steam generator to a higher temperature range than for the secondary heating operation.

12. A steam iron according to claim 1, wherein the first portion extends from the main body (11A).

13. A steam iron according to claim 1, wherein the steam iron is taken among the set of products defined by a corded steam iron and a cordless steam iron.

14. A steam iron system comprising:

a steam iron according to claim 1; and a docking station for detachably resting the steam iron.

15. A steam iron system comprising:

a steam iron according to claim 1; and a base station for carrying water to the steam iron via a cord.

16. A steam iron according to claim 1, wherein the arrangement of the thermal bridge arrangement increases the cumulated length (L1) of a thermal path between the main body and the thermal coupling area thereby restricting the rate of heat transfer to the ironing plate thus limiting the temperature of the ironing plate compared to the temperature of the main body.

17. A steam iron according to claim 1, wherein the main body and the thermal bridge are integrally formed.

18. A steam iron according to claim 17, wherein the main body and the thermal bridge are cast together.

19. A steam iron according to claim 1, wherein the thermal bridge arrangement extends in the second direction for a distance longer than in the first direction.

20. A steam iron according to claim 19, wherein the thermal bridge arrangement extends in the second direction for a distance longer than in the first direction.

21. A steam iron according to claim 1, wherein the thermal bridge arrangement extends over a peripheral portion of the steam iron.

* * * * *